US011719080B2

(12) United States Patent
Bland et al.

(10) Patent No.: US 11,719,080 B2
(45) Date of Patent: Aug. 8, 2023

(54) SENSOR SYSTEM FOR DETECTING FIBER OPTIC CABLE LOCATIONS AND PERFORMING FLOW MONITORING DOWNHOLE

(71) Applicant: Halliburton Energy Services, Inc., Houston, TX (US)

(72) Inventors: Henry Clifford Bland, Calgary (CA); Mikko K. Jaaskelainen, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 245 days.

(21) Appl. No.: 17/232,830

(22) Filed: Apr. 16, 2021

(65) Prior Publication Data

US 2022/0333468 A1 Oct. 20, 2022

(51) Int. Cl.

| | |
|---|---|
| ***E21B 43/26*** | (2006.01) |
| ***E21B 47/0224*** | (2012.01) |
| ***E21B 47/095*** | (2012.01) |
| ***E21B 43/1185*** | (2006.01) |
| ***E21B 47/0232*** | (2012.01) |
| ***E21B 47/135*** | (2012.01) |

(52) U.S. Cl.

CPC .... *E21B 43/11857* (2013.01); *E21B 43/2607* (2020.05); *E21B 47/0224* (2020.05); *E21B 47/0232* (2020.05); *E21B 47/095* (2020.05); *E21B 47/135* (2020.05)

(58) Field of Classification Search

CPC ..... E21B 47/09; E21B 47/095; E21B 47/135; E21B 47/0224

See application file for complete search history.

(56) References Cited

U.S. PATENT DOCUMENTS

| | | | |
|---|---|---|---|
| 8,584,519 | B2 | 11/2013 | Maida et al. |
| 10,444,392 | B2 | 10/2019 | Milne et al. |
| 10,626,718 | B2 | 4/2020 | Jaaskelainen et al. |

(Continued)

FOREIGN PATENT DOCUMENTS

WO WO-2020072065 A1 * 4/2020 ..... E21B 43/116

OTHER PUBLICATIONS

Silixa Ltd., "Cable Orientation Beacon," Data Sheet, 2018, 1 page.

*Primary Examiner* — Giovanna Wright

(74) *Attorney, Agent, or Firm* — Kilpatrick Townsend & Stockton LLP

(57) ABSTRACT

The way in which a fiber optic cable is wrapped around a casing string in a wellbore can be modeled using information from downhole sensor devices. For example, a system can include a fiber optic cable located along a length of a wellbore. The system can also include sensor devices located near the fiber optic cable at various depths to transmit acoustic signals indicating depths and orientations of segments of the fiber optic cable. The system can build a model describing how the fiber optic cable is positioned around the casing string based on the acoustic signals transmitted from the sensor devices. The system can also determine a target position for a perforating gun to perform a perforation operation through the casing string that avoids damaging the fiber optic cable. The system can output the target position for the perforating gun to an electronic device to facilitate the perforation operation.

20 Claims, 8 Drawing Sheets

(56) References Cited

U.S. PATENT DOCUMENTS

| | | | | |
|---|---|---|---|---|
| 2014/0204712 | A1 | 7/2014 | Skinner et al. | |
| 2017/0082766 | A1* | 3/2017 | Milne | G01D 5/14 |
| 2018/0291726 | A1* | 10/2018 | Jaaskelainen | G01V 1/52 |
| 2018/0328120 | A1 | 11/2018 | Therrien et al. | |
| 2019/0055837 | A1* | 2/2019 | San Martin | E21B 47/092 |
| 2021/0142515 | A1* | 5/2021 | Luu | G01S 15/89 |

* cited by examiner

SENSOR SYSTEM FOR DETECTING FIBER OPTIC CABLE LOCATIONS AND PERFORMING FLOW MONITORING DOWNHOLE

TECHNICAL FIELD

The present disclosure relates generally to using sensor systems for use in a wellbore. More particularly (although not necessarily exclusively), the present disclosure relates to a sensor system usable to detect the location of fiber optic cable in a wellbore for use in orienting a perforating gun during perforation operations.

BACKGROUND

A well system can include a wellbore drilled through a target reservoir. The wellbore can include a casing string that has been run into the wellbore and cemented in place. Fiber optic cables can be coupled to the outside of the casing string. As the casing string is deployed into the wellbore, it can turn. The turning of the casing string can cause the coupled fiber optic cables to wrap around the casing string. The amount and direction of wrapping is typically unknown. When making perforations in the casing string, it may be desirable to understand exactly how a fiber optic cable is wrapped around a casing string to so that perforations can be oriented to avoid damaging the fiber optic cable. Perforation operations can involve creating pathways through the casing string into portions of the wellbore to create channels for fluid and pressure communication between the target reservoir and the inside of the casing string. To determine how the fiber optic cable is wrapped around the casing string, logging operations may be performed to identify the orientation of the fiber optic cable around the casing string and how that orientation varies with depth. But logging operations can be inaccurate, time consuming, labor-intensive, and expensive to run.

DETAILED DESCRIPTION

Figure 1:
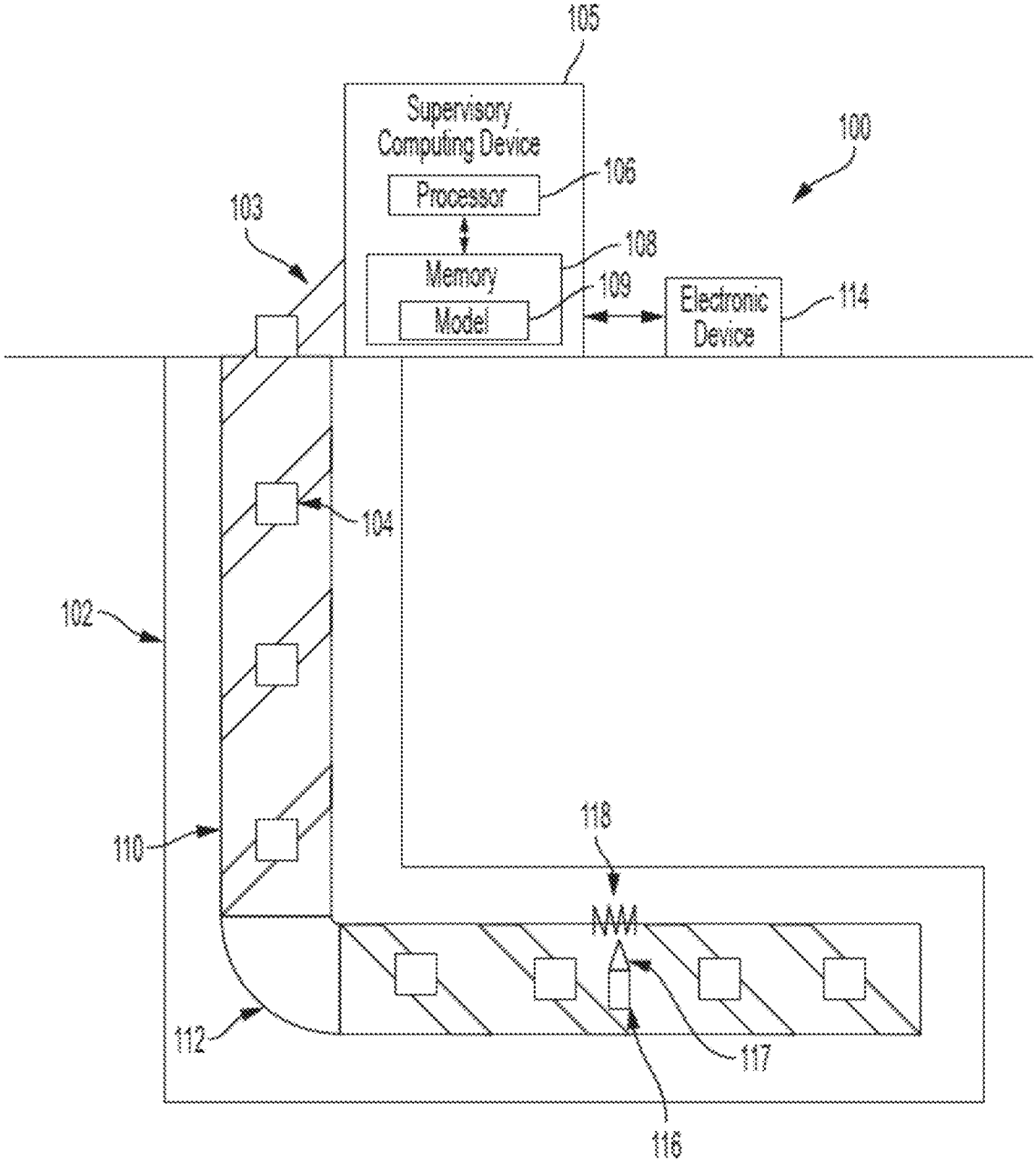
FIG. 1 is a cross-sectional side view of an example of a well system according to some aspects of the present disclosure.

Certain aspects and examples of the present disclosure relate to a supervisory computing device that receives input data from sensors deployed downhole in a wellbore, where the input data describes the orientation of a fiber optic cable coupled to a casing string in the wellbore. The supervisory computing device can then model the orientation of the fiber optic cable at some or all depths along the casing string. Using the model, the supervisory computing device can determine a target orientation at which to position a perforating gun at a target depth in the wellbore to perforate the casing string without damaging the fiber optic cable. The supervisory computing device can then output the target gun orientation for each desired perforation depth to enable the perforating gun to safely perforate the casing without colliding with the fiber optic cable.

In some examples, the process of drilling and completing a well can start with drilling a wellbore through a target reservoir, running a casing string with completion hardware into the wellbore, and cementing the casing string in place. The wellbore can be instrumented using sensor devices and fiber optic cables. The sensor devices can be connected to the casing string. The sensor devices may also be connected to the fiber optic cables or in wireless communication with the fiber optic cables. The fiber optic cables can be connected to the casing string. Examples of connection methods can include using mandrels or clamps on the outside of the casing.

When the fiber optic cables are deployed on the outside of the casing string, their angular position relative to the casing string, called the orientation, may not be known. The orientation of a fiber optic cable can be the angle formed between the fiber optic cable, the longitudinal axis of the inclined casing string, and, commonly, the topside of the wellbore. For wellbores which are perfectly vertical, and for which the topside is undefined, the direction of north may be substituted when defining the orientation angle. As the casing string is inserted into the wellbore it can turn (e.g., slightly or significantly), which can cause the attached fiber optic cables to wrap around the casing string. The final fiber optic cable orientation at certain depths along the casing string can therefore be unknown.

The wrapping of the fiber optic cables can be consistent or inconsistent depending on multiple factors. Examples of factors affecting fiber optic cable wrapping include type of deployment equipment, level of wear of the equipment, type of casing string material used, type of casing string thread used, environmental conditions, wellbore conditions, clamp design, casing string surface condition, and mechanical tolerance. The variety of factors affecting the wrapping can make it challenging to determine how the fiber optic cable is wrapped around the casing string at various depths in the wellbore.

Some examples of the present disclosure can accurately determine how a fiber optic cable is wrapped around a casing string by using multiple sensor devices positioned along a length of the casing string. Each of the sensor devices can include one or more sensor modules for detecting position information (e.g., orientation and depth information) about the fiber optic cable at a corresponding depth of the sensor device in the wellbore. The sensor devices can transmit the position information as acoustic waves using an acoustic transmitter. The fiber optic cable can detect the acoustic waves and convey the position information encoded in the acoustic waves to a supervisory computing device at the wellbore surface. The supervisory computing device can then build a fiber-location model based on the position information provided by the sensor devices. The fiber-location model may be usable by a well operator to better understand how the fiber optic cable is oriented around the casing string. When explosive charges are used to create a perforation through the casing string, it can be important to know the orientation of the fiber optic cable so that it can be avoided by the explosion and thereby prevent damage to the fiber optic cable. The model may also be usable by the supervisory computing device to determine a target orientation for a perforating gun at a target depth in the wellbore that will cause little or no harm to the fiber optic cable during a perforation operation at the target depth. In some examples, the target orientation for a perforating gun can be determined by the supervisory computing device and output to a display visible to the well operator, so that each perforating gun can be manually configured to detonate at the commanded orientation prior to deployment. In another example, the supervisory computing device can output the target position to an electronic device such as a control system configured to control (e.g., automatically control) the orientation of the perforating gun. In either example, the perforating guns are oriented to avoid damaging the fiber optic cable when detonated.

In some examples, the sensor devices can measure additional parameters, such as parameters not directly linked to the orientation of the fiber optic cable. Such parameters may include the inclination of the sensor (e.g., the wellbore inclination at the sensor's current depth), temperature, pressure, acceleration, velocity, or other parameters. The parameters may additionally or alternatively include sensor status and health information (e.g., a battery charge level or diagnostic error codes). The parameters can be used to determine if the sensor has traveled to key reference depths within the wellbore (e.g., based on inclination angle) or to determine if the sensor has stopped moving and reached its landing depth. For example, if a wellbore deviation survey is known, it may be possible to identify the time, during sensor deployment, when the sensor device reaches a reference depth in the well by matching the observed sensor inclination to a predicted well inclination at the reference depth based on the wellbore deviation survey.

In some examples, the sensor devices can perform a set of operations to determine when to detect and transmit the sensor readings or calculated quantities. For example, a sensor device can implement a first set of operations that includes the sensor device measuring the orientation angle and vibration levels using one or more sensors. The measured values can then be processed to determine relative and absolute changes with respect to one or more pre-determined levels, which may be set based on the expected completion. In some examples, the sensor device can use the measurements to determine when the sensor has reached its final landing depth and when casing string movement has stopped. Casing string movement can be detrimental to the successful reception of wireless acoustic data, so can be beneficial to postpone transmission of data until the sensor has reached its final landing depth and the wellbore is quiet.

In some examples, the sensor devices can measure and map the inclination angle during deployment of the casing string in order to estimate the point at which a horizontal section of the wellbore is reached. In some examples, the sensor device may perform measurements of orientation angle, inclination, multi-component accelerometer readings, elapsed time, and temperature throughout the deployment process. The sensor device can then determine, based on a model of the wellbore and/or the detected information, an approximate depth of the sensor device or a segment of the wellbore (e.g., build, heel, or lateral) that the sensor device is currently occupying.

In some examples, the sensor device may compute quantities based on a combination of sensor readings acquired at different times. For example, the total angular rotation between a reference depth in the wellbore and the sensor device's final landing depth may be computed. An example reference depth could be the heel of the well. In this example, the sensor device can compute its total angular rotation (or number of turns), starting from the heel up to the point at which the sensor finally stops moving, by using a multiplicity of sensor orientation angle measurements, recorded at different depths, differenced and then summed together.

In some examples, the sensor devices can measure wellbore parameters (e.g., after the well has been completed). To do so, the sensor device may include one or more sensors such as pressure, chemical, seismic, strain, resistivity, and capacitance sensors. In some examples, accelerometer sensors may be used for seismic monitoring during hydraulic fracturing. Pressure sensors measuring pressure external to the casing string may measure formation movement, compression, and fluid front movement during hydraulic fracturing. Resistance and capacitance sensors coupled to the inside of the casing may enable capacitance and resistance measurements of produced flow, which may enable multiphase flow measurements. Resistance and capacitance measurements may be detected at multiple locations along the wellbore, and the sensor devices may use the resistance and capacitance measurements to determine coherence or cross correlation measurements of the various phases during multiphase production.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional side view of an example of a well system 100 according to some aspects of the present disclosure. In this example, the well system 100 includes a wellbore 102 which is in an "L" shape, with a vertical shaft connected by a heel 112 to a horizontal shaft, but other examples can involve wells having other shapes. A casing string 110 is deployed downhole in the wellbore 102 and cemented into place. A fiber optic cable 103 wraps around the casing string 110. Sensor devices 104 are coupled to the fiber optic cable 103 at multiple depths in the wellbore 102. The fiber optic cable 103 can receive data from the sensor devices 104 and transmit the data to a supervisory computing device 105 positioned on a surface of the wellbore 102.

The supervisory computing device 105 includes a processor 106 and a memory 108 containing a model 109. The supervisory computing device 105 is communicatively coupled to an electronic device 114, which may be on the surface of the wellbore 102, immersed on the sea floor, or located downhole, such as in a well tool. In some examples, the electronic device 114 can control a position (e.g., depth and orientation) of a perforating gun 116 when generating a perforation 118. The perforating gun 116 includes a blast cap 117 for generating the perforation 118.

In some examples, the sensor devices 104 can each include sensors for detecting information indicating the position (e.g., depth and orientation) of their respective segment of the fiber optic cable 103. Examples of the detected position information can include the position of the sensor device 104, the position of a proximal segment of fiber optic cable 103, the cable orientation angle of the proximal segment of fiber optic cable 103, a number of times in which the fiber optic cable 103 is wrapped around the casing string 110 during deployment of the fiber optic cable 103 in the wellbore, and a temperature measurement of the wellbore 102. The sensor devices 104 can then incorporate the detected position information in acoustic signals for transmission to the fiber optic cable 103. The sensor devices 104 may also incorporate other detected parameters, such as a battery level of a sensor device 104, into the acoustic signals. It will be appreciated that although some examples are described herein with reference to acoustic signals and a casing string 110, these examples are intended to be illustrative and non-limiting. Other types of communications signals may also be used to convey information from the sensor devices 104 to the supervisory computing device 105 indicating how the fiber optic cable is positioned around the casing string 110 or other types of tubulars in the wellbore 102.

In some examples, the sensor devices 104 can modulate the acoustic signals using any suitable digital modulation technique to encode the desired information therein. The acoustic signals can then by transmitted by the sensor devices 104 to the fiber optic cable 103, which can detect the acoustic signals. In some examples, the fiber optic cable 103 can be interrogated by a distributed acoustic sensing ("DAS") interrogator in order to retrieve sensor signals from anywhere along the length of the fiber optic cable 103. The fiber optic cable 103 can convey modulated data indicating properties of the detected acoustic signals from the sensor devices 104 to the supervisory computing device 105.

The supervisory computing device 105 can receive the position information and other parameters encoded in the acoustic signals via the fiber optic cable 103. The processor 106 in the supervisory computing device 105 can execute instructions stored in the memory 108 to build a model 109 using the position information. The model 109 can be used to determine a target position for the perforating gun 116 to generate a perforation 118 through the casing string 110 in the wellbore 102, without damaging the fiber optic cable 103. The processor 106 can output the target position to the electronic device 114.

In some examples, the electronic device 114 can be a display visible to a well operator. Examples of the display may be a liquid crystal display ("LCD") or a light emitting diode ("LED") display. In some examples the electronic device 114 can convey the appropriate gun orientation settings to the well operator, and the well operator can manually position the perforating gun 116. In other examples, the electronic device 114 can include a control system configured to control (e.g., automatically) the position of the perforating gun 116. For example, the electronic device 114 can include a perforating gun controller, such as perforating gun controller 204 described in greater detail below with respect to FIG. 2. The perforating gun controller can physically control a spatial positioning of the perforating gun 116 to match the target position.

Figure 2:
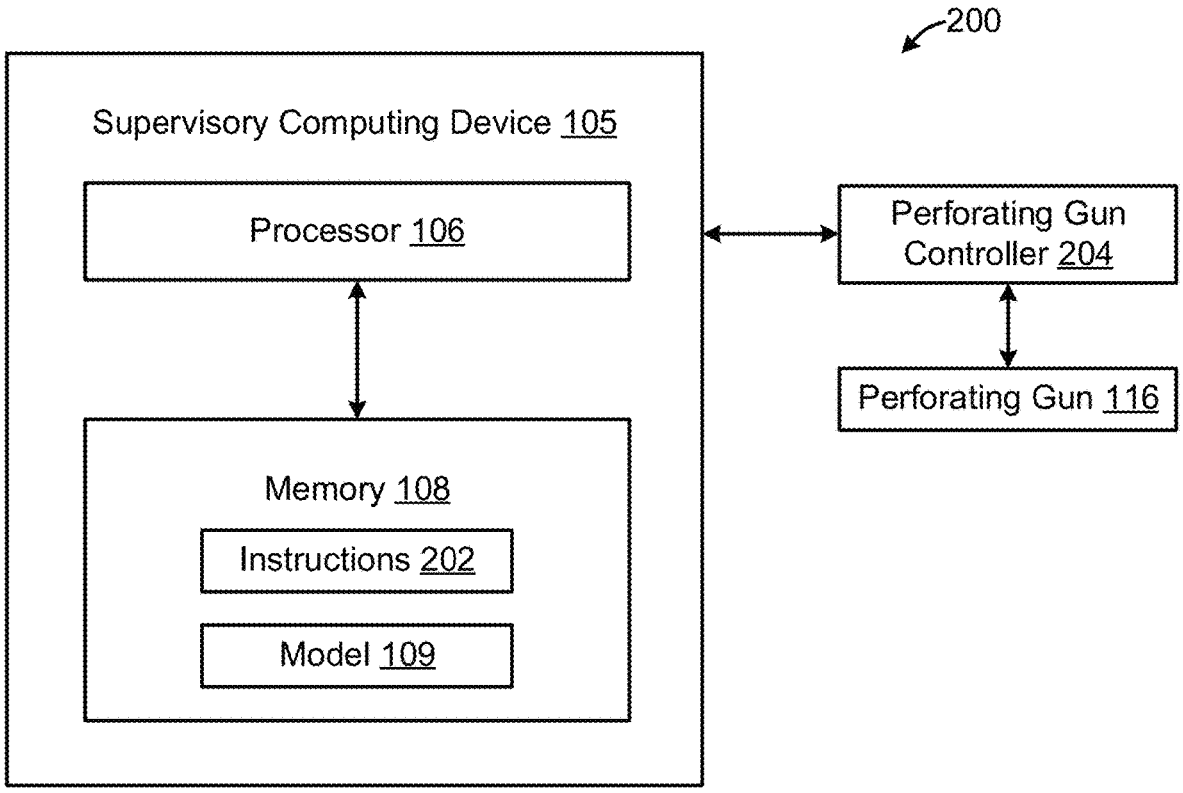
FIG. 2 is a block diagram of an example of a system according to some aspects of the present disclosure.

FIG. 2 is a block diagram of an example of a system 200 according to some aspects of the present disclosure. The system 200 can include the supervisory computing device 105 from FIG. 1 communicatively coupled to a perforating gun controller 204. The supervisory computing device 105 can include a processor 106 and a memory 108. The supervisory computing device 105 can operate (e.g., transmit control signals to) the perforating gun controller 204 to control a perforating gun 116.

In some examples, the processor 106 can execute one or more operations for modeling a wrapping of the fiber optic cable 103 around a casing string downhole in a wellbore 102. To do so, the processor 106 can execute instructions 202 stored in the memory 108. Non-limiting examples of the processor 106 include a Field-Programmable Gate Array ("FPGA"), an application-specific integrated circuit ("ASIC"), a microprocessing device, etc.

The memory 108 may include any type of memory device that retains stored information when powered off. Non-limiting examples of the memory 108 include electrically erasable and programmable read-only memory ("EEPROM"), flash memory, or any other type of non-volatile memory. In some examples, at least some of the memory 108 can include a medium from which the processor 106 can read instructions 202. A computer-readable medium can include electronic, optical, magnetic, or other storage devices capable of providing the processor 106 with computer-readable instructions or other program code. Non-limiting examples of a computer-readable medium include (but are not limited to) magnetic disk(s), memory chip(s), read-only memory ("ROM"), random-access memory ("RAM"), an ASIC, a configured processing device, optical storage, or any other medium from which a computer processor can read instructions 202. The instructions 202 can include processor-specific instructions generated by a compiler or an interpreter from code written in any suitable computer-programming language, including, for example, C, C++, C#, BANOOD, Python, Java, Rust, etc.

The memory 108 may include a model 109. The model 109 can indicate the positions of the fiber optic cable 103 along a casing string 110 or another tubular while the fiber optic cable 103 is deployed in the wellbore 102. The model 109 can be built using position information from the downhole sensor devices 104. In some examples, the positions of the fiber optic cable 103 at various depths can be modeled using spline and/or linear interpolation methods. The processor 106 can use the model 109 to determine a target position (e.g., depth and orientation) for the perforating gun 116 that will generate a perforation 118 through the casing string 110 without damaging the fiber optic cable 103 wrapped around the outside of the casing string 110. In some examples, the supervisory computing device 105 may then output the target position to a perforating gun controller 204. The perforating gun controller 204 can control the perforating gun 116 to perform a perforation operation at the target position determined by the supervisory computing device 105.

Figure 3:
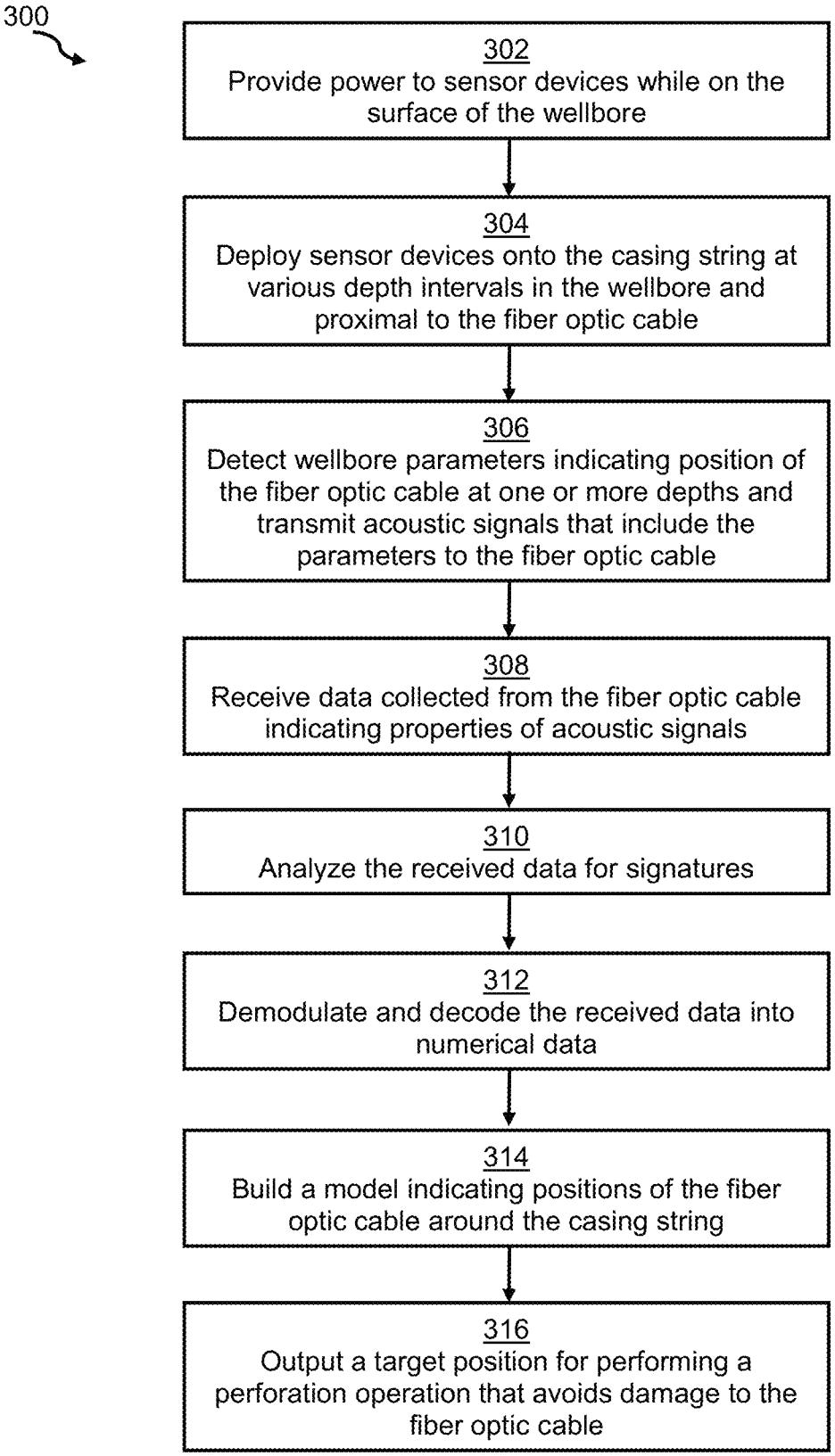
FIG. 3 is a flowchart of an example of a process for deploying and using sensor devices in a wellbore according to some aspects of the present disclosure.

FIG. 3 is a flowchart of a process 300 for deploying and using sensor devices in a wellbore 102 according to some aspects of the present disclosure. While FIG. 3 depicts a certain sequence of steps for illustrative purposes, other examples can involve more steps, fewer steps, different steps, or a different order of the steps depicted in FIG. 3. The steps of FIG. 3 are described below with reference to components of FIG. 2 above.

In block 302, the sensor devices 104 are powered on while they are on the surface of the wellbore 102, prior to being deployed into the wellbore 102. In some examples, the sensor devices 104 may be powered using batteries, and can remain continuously powered while deployed in the wellbore 102 until the battery power is depleted.

In block 304, the sensor devices 104 are deployed onto the casing string 110 at various depth intervals in the wellbore 102 and proximal to the fiber optic cable 103. In some examples, the sensor devices 104 can be attached to the fiber optic cable 103 before the fiber optic cable 103 is deployed into the wellbore 102.

In block 306, the sensor devices 104 detect parameters indicating the position of the fiber optic cable 103 at one or more depths and transmit acoustic signals that include the parameters to the fiber optic cable 103. The fiber optic cable 103 can detect the acoustic signals and convey data encoded in the acoustic signals uphole to the supervisory computing device 105. In some examples, the sensor devices 104 may transmit the same acoustic signals multiple times to improve the odds of successful transmission.

In block 308, the supervisory computing device 105 receives data collected from the fiber optic cable 103.

In block 310, the supervisory computing device 105 analyzes the received data for a signature (e.g., a predefined set of properties) associated with the acoustic signals from the sensor devices 104. For example, the fiber optic cable 103 may detect noise or otherwise extraneous information and convey that information to the supervisory computing device 105. To distinguish noise and other extraneous information from the relevant data transmitted by the sensor devices 104, the supervisory computing device 105 can analyze the received data to determine whether it includes a particular signature associated with acoustic signals from the sensor devices 104. If the signature is found, the supervisory computing device 105 may continue to further process the received data. Otherwise, the supervisory computing device 105 may discard the data. One example of a signature can include the detection of a carrier frequency of an acoustic transmission. Another example of a signature can include the detection of a characteristic prefix or postfix waveform which may be proximal to a data packet. By searching for a signature, but not performing demodulation unless a signature is found, the supervisory computing device 105 can efficiently process vast quantities of data, which can allow for real-time processing to become feasible.

In block 312, the supervisory computing device 105 demodulates and decodes the received data into numerical data. In some examples, the demodulation can be performed by a DAS interrogator system.

In block 314, the supervisory computing device 105 builds a model 109 indicating positions of the fiber optic cable 103 around the casing string 110 at some or all depths in the wellbore 102. The supervisory computing device 105 can determine the positions of the fiber optic cable 103 at one or more depths based on the numerical data. In some examples, the supervisory computing device 105 can use interpolation to determine positions of the fiber optic cable at depths that do not have corresponding sensor devices.

In block 316, the supervisory computing device 105 outputs a target position (e.g., depth and orientation) for performing a perforation operation in the wellbore 102 that avoids damage to the fiber optic cable 103. The supervisory computing device 105 can output the target position to an electronic device 114, such as a perforating gun controller 204 that controls a perforating gun 116, for causing the perforation 118 to be performed at the target position. In some examples, the supervisory computing device 105 may communicate the target position to an operator, data base, or any computer or data storage not limited to personal computing devices, cloud based storage, or perforating software equipment.

Figure 4:
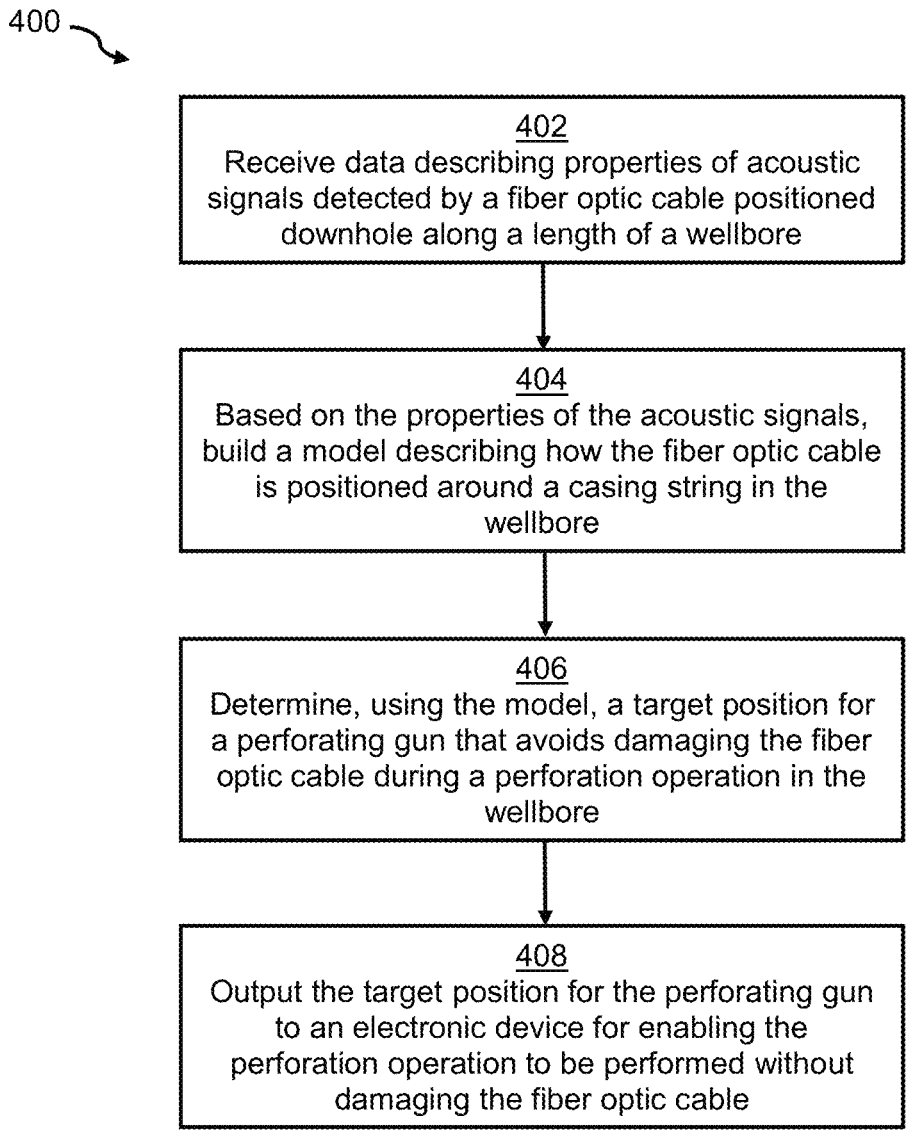
FIG. 4 is a flowchart of an example of a process for determining an orientation for a perforating gun in a wellbore according to some aspects of the present disclosure.

FIG. 4 is a flowchart of an example of a process for determining an orientation for a perforating gun in a wellbore according to some aspects of the present disclosure. While FIG. 4 depicts a certain sequence of steps for illustrative purposes, other examples can involve more steps, fewer steps, different steps, or a different order of the steps depicted in FIG. 4. The steps of FIG. 4 are described below with reference to components of FIG. 2 above.

In block 402, the supervisory computing device 105 receives data describing properties (e.g., amplitudes, frequencies, waveforms, durations, and/or encoded information) of acoustic signals detected by a fiber optic cable 103 positioned downhole along a length of a wellbore.

In block 404, the supervisory computing device 105 builds a model 109 describing how the fiber optic cable 103 is positioned around the casing string 110 in the wellbore based on the properties of the acoustic signals.

In block 406, the supervisory computing device 105 determines, using the model 109, a target position for a perforating gun 116 that avoids damaging the fiber optic cable 103 during a perforation operation in the wellbore. The supervisory computing device 105 may determine a placement for the perforating gun 116 where it can be located a target distance away from a loop of the fiber optic cable 103 around the casing string 110. The supervisory computing device 105 may determine an orientation of the perforating gun 116 such that when a perforation operation occurs, the fiber optic cable 103 may not be damaged.

In block 408, the supervisory computing device 105 outputs the target position for the perforating gun 116 to an electronic device 114 for enabling the perforation operation to be performed without damaging the fiber optic cable 103.

Figure 5:
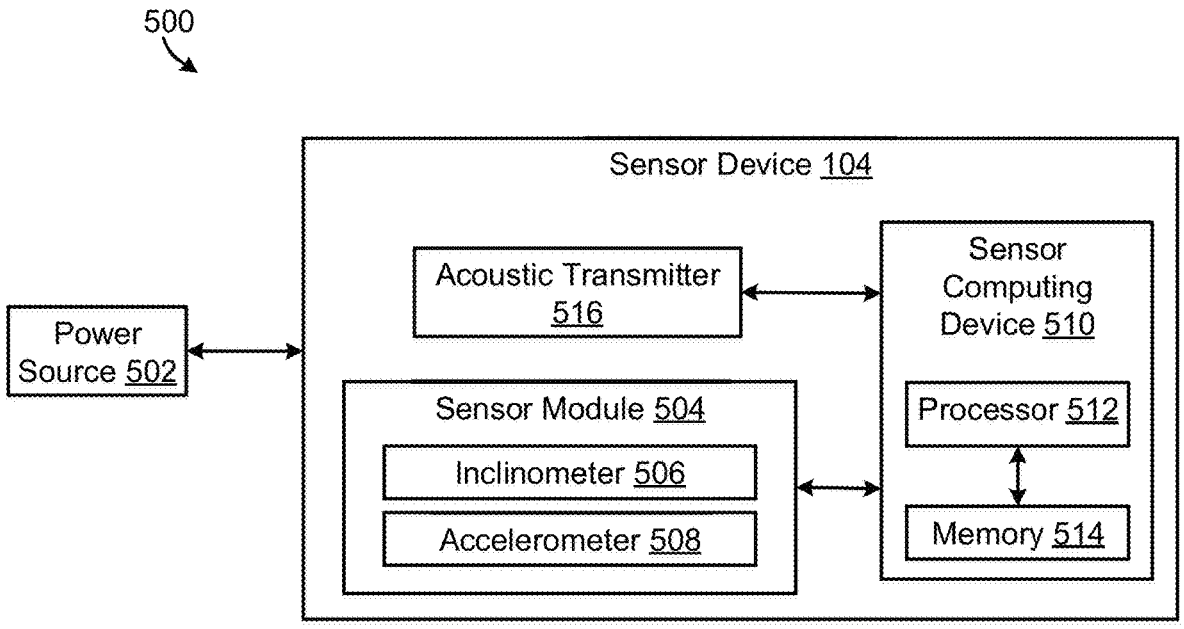
FIG. 5 is a block diagram of an example of a sensor device according to some aspects of the present disclosure.

FIG. 5 is a block diagram of an example of a sensor device 104 according to some aspects of the present disclosure. The sensor device 104 can contain a sensor computing device 510, a sensor module 504, and an acoustic transmitter 516, though other types of transmitters can be used. The sensor device 104 can be coupled to a power source 502.

The power source 502 can be located internally or externally to the sensor device 104. In some examples, the power source 502 can be a battery that is positioned within and activated in the sensor device 104 before the sensor device 104 is deployed into the wellbore 102. Alternatively, the power source 502 can provide power to the sensor device 104 through wired power from the surface of the wellbore 102.

The sensor module 504 can include one or more sensors such as an inclinometer 506 and an accelerometer 508. The inclinometer 506 can measure an inclination of the sensor module 504 in one or more axes. The accelerometer 508 can also be used to measure inclination in one or more axes. Additionally, the accelerometer 508 can measure vibration levels one or more axes. The sensor module 504 can additionally or alternatively include one or more of flow, temperature, pressure, differential pressure, acoustic, vibration, accelerometer(s), geophone(s), resistance, capacitance, and chemical sensors. The sensor module can transmit sensor signals from the inclinometer, accelerometer, and other sensors to the sensor computing device 510. In some examples, the sensor module 504 can be an electroacoustic technology ("EAT") sensing device.

The sensor computing device 510 can contain a processor 512 communicatively coupled to a memory 514. The processor can include one processor or multiple processors. Non-limiting examples of the processor 512 include an FPGA, an ASIC, a microprocessor, etc. The processor 512 can execute instructions stored in the memory 514 to perform operations. In some examples, the instructions can include processor-specific instructions generated by a compiler or an interpreter from code written in any suitable computer-programming language, such as C, C++, C#, etc.

The memory 514 can include one memory device or multiple memory devices. The memory 514 can be non-volatile and may include any type of memory device that retains stored information when powered off. Non-limiting examples of the memory 514 include EEPROM, flash memory, or any other type of non-volatile memory. At least some of the memory device includes a non-transitory computer-readable medium from which the processor 512 can read instructions. A non-transitory computer-readable medium can include electronic, optical, magnetic, or other storage devices capable of providing the processor 512 with the instructions or other program code. Non-limiting examples of a non-transitory computer-readable medium include magnetic disk(s), memory chip(s), ROM, RAM, an ASIC, a configured processor, optical storage, or any other medium from which a computer processor can read the instructions.

The processor 512 can receive the sensor signals from the sensor module and, using instructions from the memory 514, digitally encode some or all of the sensor signals into at least one acoustic signal using at least one digital modulation technique. In some examples, digital modulation techniques can include phase-shift keying, frequency-shift keying, and amplitude-shift keying. The acoustic transmitter 516 can transmit the modulated acoustic signal to a fiber optic cable 103. In some examples, transmission may occur at a predetermined interval, or may be triggered by one or more events such as a change of one or more of temperature, pressure, resistance, capacitance, chemical changes, or processed values.

The sensor device 104 can include the acoustic transmitter 516, which can be any suitable type of transmitter of acoustic waves. Examples of the acoustic transmitter 516 can include a speaker or an ultrasonic transducer (e.g., a piezoelectric transducer). In other examples, the sensor device 104 can include other types of transmitters additionally or alternatively to the acoustic transmitter 516. The other types of transmitters can transmit other types of signals that include the desired data using other techniques.

Figure 6:
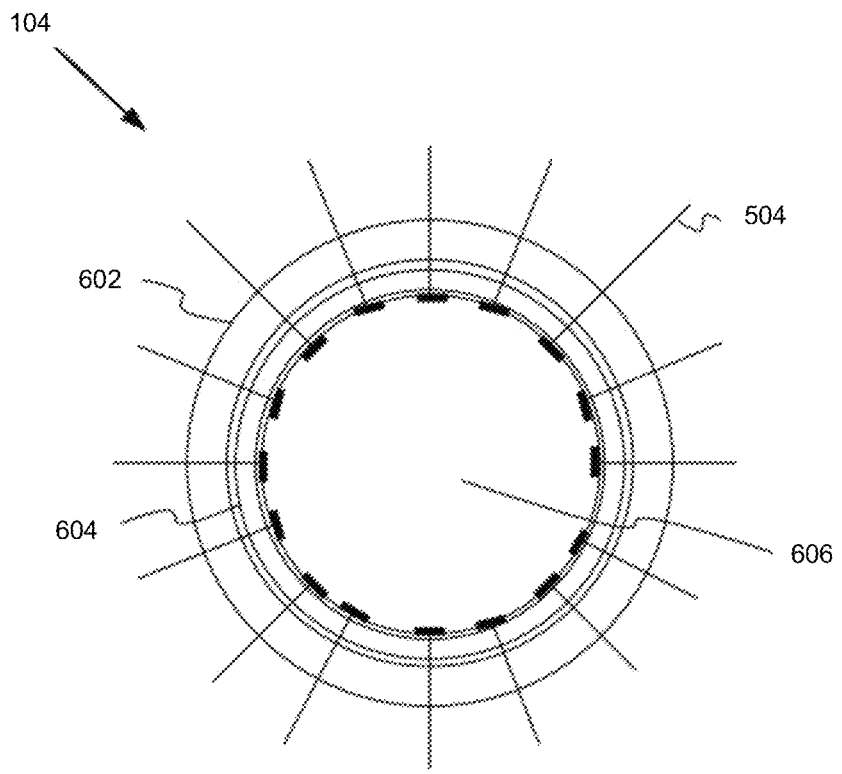
FIG. 6 is a schematic view of an example of a sensor device according to some aspects of the present disclosure.

FIG. 6 is a schematic view of an example of a sensor device 104 according to some aspects of the present disclosure. In this example, the sensor device 104 can be an EAT sensing device. The sensor device 104 may include one or more sensors, electronics, batteries, and acoustic transducers for data transmission to a fiber optical cable 103. The sensor device 104 can be comprised of a metal pipe 602, an insulating pipe 604, and one or more sensor modules 504 that contains an imaging area 606. In this example, the sensor device 104 can include sixteen sensor modules 504, although a different number of sensing modules may be used. The sensor modules 504 may be of similar or different types and may measure one or more parameters such as resistance or capacitance.

In some examples, sensor devices 104 can be used for flow monitoring, including different fluid velocities and flow regimes over depths along the wellbore 102 over time. In some examples, the sensor modules 504 can be placed around the perimeter of the sensor device 104 to detect flow parameters at different areas in the wellbore 102 using multiple sensor devices 104. The metal pipe 602 and insulating pipe 604 can protect some or all components of the sensor modules 504 and sensor device 104 from being damaged by the flow and/or mechanical damage during casing deployment. In some examples, a stratified flow system can comprise fluids in a wellbore 102 that are separated due to different fluid densities, velocities, and flow regimes. Multiple sensor devices 104 with multiple sensor modules 504 can be placed in multiple locations in the wellbore 102, and the imaging area 606 for each sensor device 104 can use cross correlation of sensor signals between measurement locations of different sensor devices 104 for multi-phase measurements to determine different phases of the stratified or turbulent flow systems. By doing so, data from the imaging area 606 can then be used to measure the travel time of each phase between sensor device 104 locations, as lighter fluids and gases can travel faster than heavier fluids and gases.

Figure 7A:
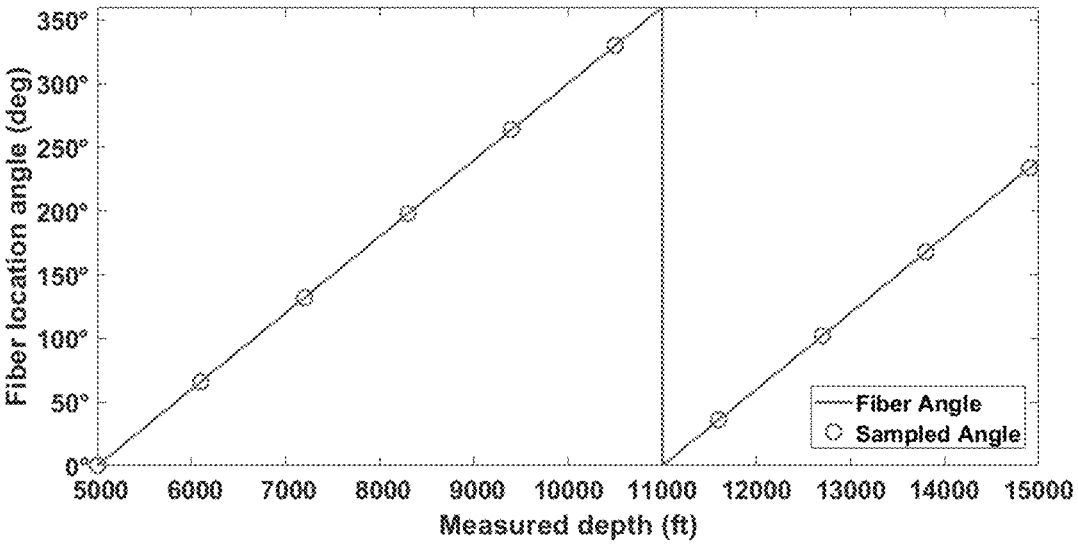
FIG. 7A is a plot of an example of true location angles for a fiber optic cable and sampled location angles for the fiber optic cable at various depths in a wellbore according to some aspects of the present disclosure.

FIG. 7A is a plot of an example of true location angles for a fiber optic cable and sampled location angles for the fiber optic cable at various depths in a wellbore according to some aspects of the present disclosure. FIG. 7A shows nine sampled location angles for the fiber optic cable. In some examples, interpolating a model of the fiber optic cable's position from the sampled location angles would yield the true position of the fiber optic cable. But if the fiber optic cable 103 was wrapped more frequently around the casing string as shown in FIG. 7B, then just interpolating from the sampled angles may not yield an accurate model.

Figure 7B:
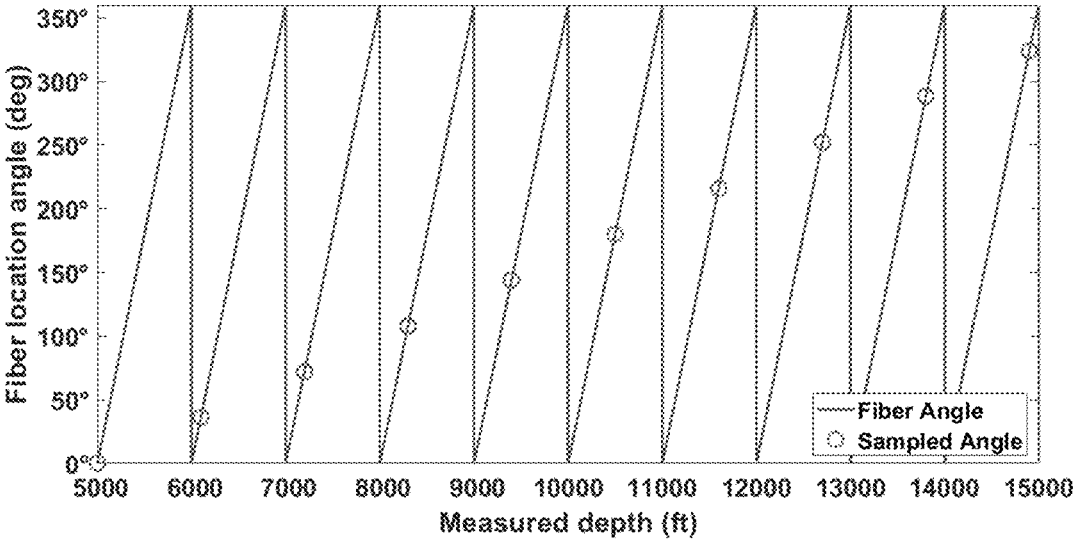
FIG. 7B is a plot of an example of true location angles for a fiber optic cable and sampled location angles for the fiber optic cable at various depths in a wellbore according to some aspects of the present disclosure.

FIG. 7B is a plot of an example of true location angles for a fiber optic cable and sampled location angles for the fiber optic cable at various depths in a wellbore according to some aspects of the present disclosure. FIG. 7B shows ten sampled location angles for the fiber optic cable 103. In some examples, interpolating a model of the fiber optic cable's position from the sampled location angles would not produce the same position as the true fiber optic cable position, due to the high rate of wrap of the fiber optic cable 103 around the casing string 110. While this issue may be resolved by increasing the number of sensor devices 104 downhole, it may be difficult to know how many sensor devices 104 to deploy downhole ahead of time because it is not easy to predict how many times the fiber optic cable 103 will wrap around the casing string 110. In some examples, the process shown in FIG. 8 can be used to overcome this difficulty.

Figure 8:
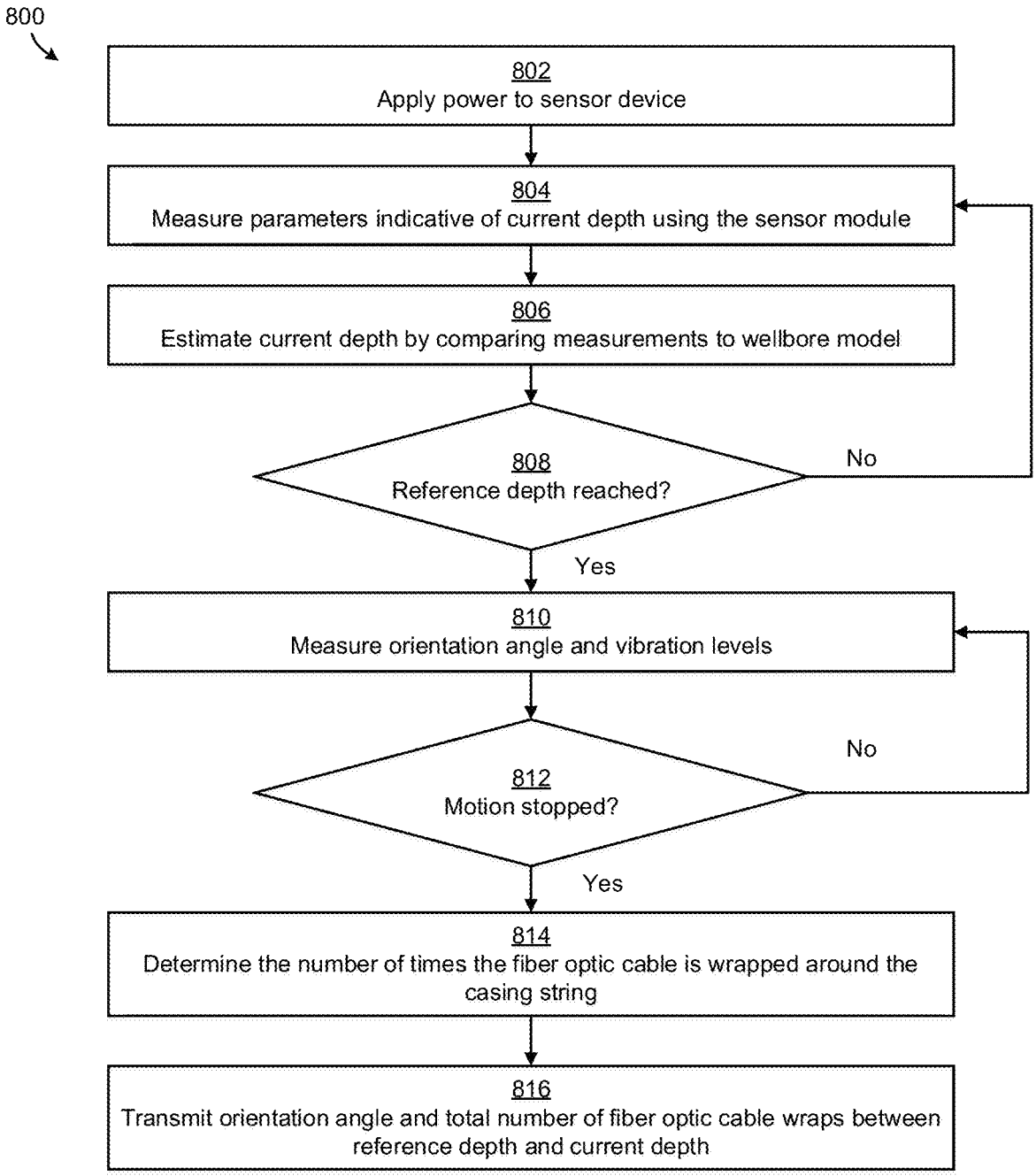
FIG. 8 is a flowchart of an example of a process associated with a sensor device according to some aspects of the present disclosure.

FIG. 8 is a flowchart of an example of a process 800 associated with a sensor device 104 according to some aspects of the present disclosure. While FIG. 8 depicts a certain sequence of steps for illustrative purposes, other examples can involve more steps, fewer steps, different steps, or a different order of the steps depicted in FIG. 8. The steps of FIG. 8 are described below with reference to components of FIG. 5 above.

In block 802, a power source 502 applies power to a sensor device 104. In some examples, the sensor device 104 can be powered using a battery attached to the sensor device 104. The sensor device 104 can be powered on before being deployed downhole into a wellbore.

In block 804, the sensor module 504 located inside the sensor device 104 measures one or more parameters, such as inclination, temperature, orientation angle, or deployment time of the sensor device 104 in the wellbore. The parameters can be indicative of the current depth of the sensor module 504.

In block 806, the sensor computing device 510 in the sensor device 104 can estimate the current depth of the sensor device 104 in the wellbore 102. The sensor module 504 can estimate the current depth of the sensor device 104 using relative or absolute measurements of the measured parameters, for example by using relative or absolute measurements of orientation, inclination, multi-component accelerometer readings, elapsed time, temperature and other sensor readings that can be compared with pre-determined levels based on expected completion geometry. In some examples, the sensor module 504 can estimate the current depth by comparing the measured parameters (e.g., successive measured parameters) with modeled parameter measurements for a wellbore of the same or similar shape.

In block 808, the sensor computing device 510 determines if a reference depth has been reached by comparing the reference depth to the current location of the sensor device 104 in the wellbore 102 (e.g., as determined in block 806). In some examples, the reference depth can be the heel 112 of the wellbore 102. If the reference depth has not been reached, the process is routed back to block 804. If the reference depth has been reached, it may mean that a particular region of the wellbore has been reached at which point the sensor device 104 is to begin taking sensor measurements. So, the process can continue to block 810.

In block 810, the sensor computing device 510 measures the orientation angle and vibration levels of the sensor device 104 at its current location in the wellbore. In some examples, the orientation angle can be measured by an inclinometer 506 situated to measure the orientation angle of the sensor. Alternatively, an accelerometer 508 in the sensor module 504 of the sensor device 104 may be used to measure the sensor's orientation angle. Here, the relationship between perpendicular accelerometer components can be used to compute orientation angle. In some examples, the vibration levels can be measured by an accelerometer 508 in the sensor module 504 in the sensor device 104.

In block 812, the sensor computing device 510 determines if motion has stopped (e.g., the sensor device 104 has stopped moving) using the orientation angle and/or vibration levels. For example, the sensor computing device 510 can determine that the motion has stopped based on the orientation angle remaining substantially constant over a period of time. Additionally or alternatively, the sensor computing device 510 can determine that the motion has stopped based on vibration levels detected by an accelerometer subsiding to a level that correlates with stopped motion. If the motion has not stopped, the process is routed back to block 810. If the motion has stopped, the process continues to block 814.

In block 814, the sensor computing device 510 determines the number of times the fiber optic cable 103 is wrapped around the casing string 110 using the cumulative orientation angle measured between the reference depth and the point at which the sensor device stopped moving (e.g., a final landing depth of the sensor). In some examples, each time the sensor's orientation angle is measured, the sensor computing device 510 can determine a difference in orientation angle from the previous orientation angle measurement. The sensor computing device 510 can determine a number of times the fiber optic cable 103 has wrapped around the casing string 110 between orientation angle measurements using the cumulative sum of the differences in orientation angle measurements. The cumulative sum of orientation angle can be divided by 360 degrees, resulting in a (possibly fractional) count of the number of wraps of fiber between the reference point and the final landing depth of each sensor.

In block 816, the acoustic transmitter 516 in the sensor device 104 transmits the total number of times the fiber optic cable 103 is wrapped around the casing string 110 between the reference depth and the final landing depth. For example, the acoustic transmitter 616 may transmit an acoustic signal with the total number of times encoded therein using one or more modulation techniques. Additional parameters (e.g. orientation angle and temperature) detected by the sensor device 104 may also be transmitted at this time.

While the above examples involve the sensor device 104 measuring orientation angles and vibration levels as the sensor device 104 moves downhole from the reference depth to a final landing depth, other examples can involve the sensor device 104 measuring the orientation angles and vibration levels in any segment of the wellbore that may or may not terminate at the final landing depth of the sensor device 104. For instance, the sensor device 104 can measure orientation angles and vibration levels as the sensor device 104 moves from a first depth (e.g., the reference depth) to a second depth, where the second depth may or may not correspond to the final landing depth of the sensor device 104.

In some aspects, systems and methods for detecting fiber optic cable positions and performing flow monitoring downhole are provided according to one or more of the following examples:

Example #1: A system can include a fiber optic cable positionable downhole along a length of a wellbore, a plurality of sensor devices positionable in proximity to the fiber optic cable at a plurality of depths in the wellbore, a processor, and a memory. The fiber optic cable can detect a plurality of acoustic signals. The plurality of sensor devices can transmit the plurality of acoustic signals to the fiber optic cable, with each sensor device in the plurality of sensor devices being configured to transmit a respective acoustic signal indicating a respective depth and orientation of a respective segment of the fiber optic cable that is associated with the sensor device. The memory can include instructions that are executable by the processor for causing the processor to perform operations. The operations can include receiving data describing properties of the plurality of acoustic signals detected by the fiber optic cable. The operations can include, based on the properties of the plurality of acoustic signals, building a model describing how the fiber optic cable is positioned around a casing string in the wellbore. The operations can include determining, using the model, a target orientation for a perforating gun that avoids damaging the fiber optic cable during a perforation operation at a target depth in the wellbore. The operations can include outputting the target orientation for the perforating gun to an electronic device for enabling the perforation operation to be performed at the target depth without damaging the fiber optic cable.

Example #2: The system of Example #1 may feature a sensor device in the plurality of sensor devices including an acoustic transmitter, a sensor module including one or more sensors, and a sensor device communicatively coupled to the acoustic transmitter and the sensor module. The sensor computing device can be configured to perform operations. The operations can include receiving measured parameters indicating a position of the sensor module in the wellbore. The operations can include determining, based on the measured parameters, that the sensor device is located at a reference depth in the wellbore. The operations can include, in response to determining that the sensor device is located at the reference depth in the wellbore, obtaining a plurality of orientation angle measurements as the sensor device moves farther downhole from the reference depth. The operations can include, subsequent to determining the plurality of orientation angle measurements, determining that the sensor device is stationary. The operations can include, subsequent to determining that the sensor device is stationary, operating the acoustic transmitter to transmit at least one orientation angle measurement of the plurality of orientation angle measurements in at least one acoustic signal to the fiber optic cable.

Example #3: The system of any of Examples #1-2 may feature a sensor device being configured to perform operations. The operations can include determining a number of times in which the fiber optic cable is wrapped, in whole or in part, around the casing string between a reference depth and a final landing depth of the sensor device during deployment of the fiber optic cable in the wellbore. The operations can include incorporating the number of times into the at least one acoustic signal.

Example #4: The system of any of Examples #1-3 may feature a sensor device that is configured to determine that the sensor device is stationary by detecting a reduced vibration level as compared to a prior vibration level, detecting a reduction of orientation angle variance, or detecting that a predefined amount of time has passed.

Example #5: The system of any of Examples #1-4 may feature a sensor device of the plurality of sensor devices being configured to digitally encode an orientation angle measurement, a temperature, a pressure, a battery level, an inclination angle, and/or a fractional number of times that the fiber optic cable is wrapped around the casing string using one or more digital modulation techniques.

Example #6: The system of any of Examples #1-5 may feature a sensor device of the plurality of sensor devices being configured to be powered on at a surface of the wellbore prior to being deployed into the wellbore, and may feature the sensor device remaining continuously powered while inside the wellbore until a battery of the sensor device is depleted.

Example #7: The system of any of Examples #1-6 may feature the memory further including instructions that are executable by the processor for causing the processor to perform operations. The operations can include receiving information collected from an interrogator of the fiber optic cable. The operations can include analyzing characteristics of the information to determine that the information has a signature associated with acoustic transmissions from the plurality of sensor devices. The operations can include, in response to determining that the information has the signature, demodulating the information to obtain position information describing how the fiber optic cable is positioned around the casing string. The operations can include building the model based on the position information.

Example #8: A method can include receiving data describing properties of a plurality of acoustic signals detected by a fiber optic cable positionable downhole along a length of a wellbore. The method can include, based on the properties of the plurality of acoustic signals, building a model describing how the fiber optic cable is positioned around a casing string in the wellbore. The method can include determining, using the model, a target orientation for a perforating gun that avoids damaging the fiber optic cable during a perforation operation at a target depth in the wellbore. The method can include outputting the target orientation for the perforating gun to an electronic device for enabling the perforation operation to be performed at the target depth without damaging the fiber optic cable. Some or all of the method steps may be implemented by a processor.

Example #9: The method of Example #8 may feature positioning a plurality of sensor devices in proximity to the fiber optic cable at a plurality of depths in the wellbore for transmitting the plurality of acoustic signals to the fiber optic cable. Each sensor device in the plurality of sensor devices may be configured to transmit a respective acoustic signal indicating a respective depth and orientation of a respective segment of the fiber optic cable that is associated with the sensor device.

Example #10: The method of any of Examples #8-9 may feature a sensor device of the plurality of sensor devices including an acoustic transmitter, a sensor module including one or more sensors, and a sensor computing device communicatively coupled to the acoustic transmitter and the sensor module. The sensor computing device can be configured to perform operations. The operations can include receiving measured parameters indicating a position of the sensor module in the wellbore. The operations can include determining, based on the measured parameters, that the sensor device is located at a reference depth in the wellbore. The operations can include, in response to determining that the sensor device is located at the reference depth in the wellbore, obtaining a plurality of orientation angle measurements as the sensor device moves farther downhole from the reference depth. The operations can include, subsequent to determining the plurality of orientation angle measurements, determining that the sensor device is stationary. The operations can include, subsequent to determining that the sensor device is stationary, operating the acoustic transmitter to transmit at least one orientation angle measurement of the plurality of orientation angle measurements in at least one acoustic signal to the fiber optic cable.

Example #11: The method of Example #10 may feature the sensor device being configured to perform operations. The operations can include determining a number of times in which the fiber optic cable is wrapped, in whole or in part, around the casing string between the reference depth and a final landing depth of the sensor device during deployment of the fiber optic cable in the wellbore. The operations can include incorporating the number of times into the at least one acoustic signal.

Example #12: The method of any of Examples #10-11 may feature the sensor device being configured to determine that the sensor device is stationary by detecting a reduced vibration level as compared to a prior vibration level, detecting a reduction of orientation angle variance, or detecting that a predefined amount of time has passed.

Example #13: The method of any of Examples #10-12 may feature the sensor device being configured to digitally encode an orientation angle measurement, a temperature, a pressure, a status condition, an inclination angle, and/or a fractional number of times that the fiber optic cable is wrapped around the casing string using one or more digital modulation techniques.

Example #14: The method of any of Examples #10-13 may feature the sensor device being powered on at a surface of the wellbore prior to being deployed into the wellbore, and may feature the sensor device remaining continuously powered while inside the wellbore until a battery of the sensor device is depleted.

Example #15: The method of any of Examples #8-14 may involve receiving information collected from an interrogator of the fiber optic cable. The method may involve analyzing characteristics of the information to determine that the information has a signature associated with acoustic transmissions from the plurality of sensor devices. The method may involve, in response to determining that the information has the signature, demodulating the information to obtain position information describing how the fiber optic cable is positioned around the casing string. The method may involve building the model based on the position information. Some or all of the method steps may be implemented by a processor.

Example #16: A system can include a plurality of sensor devices positionable in proximity to a fiber optic cable at a plurality of depths in a wellbore for transmitting a plurality of signals to the fiber optic cable. Each sensor device of the plurality of sensor devices can include a transmitter, a sensor module including one or more sensors, and a sensor computing device communicatively coupled to the transmitter and the sensor module. The sensor computing device may be configured to perform operations. The operations can include receiving measured parameters indicating a position of the sensor module in the wellbore. The operations can include determining, based on the measured parameters, that the sensor device is located at a reference depth in the wellbore. The operations can include, in response to determining that the sensor device is located at the reference depth in the wellbore, obtaining a plurality of orientation angle measurements as the sensor device moves farther downhole from the reference depth. The operations can include, subsequent to determining the plurality of orientation angle measurements, determining that the sensor device is stationary. The operations can include, subsequent to determining that the sensor device is stationary, operating the transmitter to transmit at least one orientation angle measurement of the plurality of orientation angle measurements in at least one signal.

Example #17: The system of Example #16 may feature each sensor device of the plurality of sensor devices being configured to perform operations. The operations can include determining a number of times in which the fiber optic cable is wrapped, in whole or in part, around the casing string between the reference depth and a final landing depth of the sensor device during deployment of the fiber optic cable in the wellbore. The operations can include incorporating the number of times into the at least one signal.

Example #18: The system of any of Examples #16-17 may feature a sensor device being configured to determine that the sensor device is stationary by detecting a reduced vibration level as compared to a prior vibration level, detecting a reduction of orientation angle variance, or detecting that a predefined amount of time has passed.

Example #19: The system of any of Examples #16-18 may feature each sensor device being configured to digitally encode an orientation angle measurement, a temperature, a pressure, a battery level, an inclination angle, and/or a fractional number of times that the fiber optic cable is wrapped around the casing string using one or more digital modulation techniques.

Example #20: The system of any of Examples #16-19 may feature a processor and a memory positionable at a surface of the wellbore. The memory can include instructions that are executable by the processor for causing the processor to perform operations. The operations can include receiving data describing properties of the plurality of signals. The operations can include, based on the properties of the plurality of signals, determining a target orientation for a perforating gun that avoids damaging the fiber optic cable during a perforation operation at a target depth in the wellbore. The operations can include outputting the target orientation for the perforating gun to an electronic device for enabling the perforation operation to be performed at the target depth without damaging the fiber optic cable.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a fiber optic cable positionable downhole along a length of a wellbore to detect a plurality of acoustic signals;

a plurality of sensor devices positionable in proximity to the fiber optic cable at a plurality of depths in the wellbore for transmitting the plurality of acoustic signals to the fiber optic cable, each sensor device in the plurality of sensor devices being configured to transmit a respective acoustic signal indicating a respective depth and orientation of a respective segment of the fiber optic cable that is associated with the sensor device, wherein, for a sensor device in the plurality of sensor devices, the respective acoustic signal further indicates an angular rotation of the sensor device between a reference depth and a final landing depth of the sensor device;

a processor; and a memory including instructions that are executable by the processor for causing the processor to:

receive data describing properties of the plurality of acoustic signals detected by the fiber optic cable;

based on the properties of the plurality of acoustic signals, build a model describing how the fiber optic cable is positioned around a casing string in the wellbore;

determine, using the model, a target orientation for a perforating gun that avoids damaging the fiber optic cable during a perforation operation at a target depth in the wellbore; and automatically control the perforating gun to be positioned at the target orientation for enabling the perforation operation to be performed at the target depth without damaging the fiber optic cable.

2. The system of claim 1, wherein the sensor device in the plurality of sensor devices includes:

an acoustic transmitter;

a sensor module including one or more sensors; and a sensor computing device communicatively coupled to the acoustic transmitter and the sensor module, the sensor computing device being configured to:

receive measured parameters indicating a position of the sensor module in the wellbore;

determine, based on the measured parameters, that the sensor device is located at a reference depth in the wellbore;

in response to determining that the sensor device is located at the reference depth in the wellbore, obtain a plurality of orientation angle measurements as the sensor device moves farther downhole from the reference depth;

subsequent to determining the plurality of orientation angle measurements, determine that the sensor device is stationary; and subsequent to determining that the sensor device is stationary, operate the acoustic transmitter to transmit at least one orientation angle measurement of the plurality of orientation angle measurements in at least one acoustic signal to the fiber optic cable.

3. The system of claim 2, wherein the sensor device is configured to:

determine a number of times in which the fiber optic cable is wrapped, in whole or in part, around the casing string between the reference depth and a final landing depth of the sensor device during deployment of the fiber optic cable in the wellbore; and incorporate the number of times into the at least one acoustic signal.

4. The system of claim 3, wherein the sensor device is configured to determine that the sensor device is stationary by detecting a reduced vibration level as compared to a prior vibration level, detecting a reduction of orientation angle variance, or detecting that a predefined amount of time has passed.

5. The system of claim 1, wherein the sensor device of the plurality of sensor devices is configured to digitally encode an orientation angle measurement, a temperature, a pressure, a battery level, an inclination angle, or a fractional number of times that the fiber optic cable is wrapped around the casing string using one or more digital modulation techniques.

6. The system of claim 1, wherein the sensor device of the plurality of sensor devices is configured to be powered on at a surface of the wellbore prior to being deployed into the wellbore, and wherein the sensor device is configured to remain continuously powered while inside the wellbore until a battery of the sensor device is depleted.

7. The system of claim 1, wherein the instructions are further executable by the processor for causing the processor to:

receive information collected from an interrogator of the fiber optic cable;

analyze characteristics of the information to determine that the information has a signature associated with acoustic transmissions from the plurality of sensor devices;

in response to determining that the information has the signature, demodulate the information to obtain position information describing how the fiber optic cable is positioned around the casing string; and build the model based on the position information.

8. The system of claim 1, wherein the model is a spline model or a linear interpolation model.

9. A method comprising:

positioning a plurality of sensor devices in proximity to a fiber optic cable positionable downhole along a length of a wellbore at a plurality of depths in the wellbore for transmitting a plurality of acoustic signals to the fiber optic cable, each sensor device in the plurality of sensor devices being configured to transmit a respective acoustic signal indicating a respective depth and orientation of a respective segment of the fiber optic cable that is associated with the sensor device;

receiving, by a processor, data describing properties of the plurality of acoustic signals detected by the fiber optic cable, wherein, for a sensor device of the plurality of sensor devices, the respective acoustic signal further indicates an angular rotation of the sensor device between a reference depth and a final landing depth of the sensor device;

based on the properties of the plurality of acoustic signals, building, by the processor, a model describing how the fiber optic cable is positioned around a casing string in the wellbore;

determining, by the processor using the model, a target orientation for a perforating gun that avoids damaging the fiber optic cable during a perforation operation at a target depth in the wellbore; and automatically controlling, by the processor, the perforating gun to be positioned at the target orientation for enabling the perforation operation to be performed at the target depth without damaging the fiber optic cable.

10. The method of claim 9, wherein the sensor device of the plurality of sensor devices includes:

an acoustic transmitter;

a sensor module including one or more sensors; and a sensor computing device communicatively coupled to the acoustic transmitter and the sensor module, the sensor computing device being configured to:

receive measured parameters indicating a position of the sensor module in the wellbore;

determine, based on the measured parameters, that the sensor device is located at a reference depth in the wellbore;

in response to determining that the sensor device is located at the reference depth in the wellbore, obtain a plurality of orientation angle measurements as the sensor device moves farther downhole from the reference depth;

subsequent to determining the plurality of orientation angle measurements, determine that the sensor device is stationary; and subsequent to determining that the sensor device is stationary, operate the acoustic transmitter to transmit at least one orientation angle measurement of the plurality of orientation angle measurements in at least one acoustic signal to the fiber optic cable.

11. The method of claim 10, wherein the sensor device is configured to:

determine a number of times in which the fiber optic cable is wrapped, in whole or in part, around the casing string between the reference depth and a final landing depth of the sensor device during deployment of the fiber optic cable in the wellbore; and incorporate the number of times into the at least one acoustic signal.

12. The method of claim 10, wherein the sensor device is configured to determine that the sensor device is stationary by detecting a reduced vibration level as compared to a prior vibration level, detecting a reduction of orientation angle variance, or detecting that a predefined amount of time has passed.

13. The method of claim 10, wherein the sensor device is configured to digitally encode an orientation angle measurement, a temperature, a pressure, a status condition, an inclination angle, or a fractional number of times that the fiber optic cable is wrapped around the casing string using one or more digital modulation techniques.

14. The method of claim 10, wherein the sensor device is configured to be powered on at a surface of the wellbore prior to being deployed into the wellbore, and wherein the sensor device is configured to remain continuously powered while inside the wellbore until a battery of the sensor device is depleted.

15. The method of claim 9, further comprising:

receiving, by the processor, information collected from an interrogator of the fiber optic cable;

analyzing, by the processor, characteristics of the information to determine that the information has a signature associated with acoustic transmissions from the plurality of sensor devices;

in response to determining that the information has the signature, demodulating, by the processor, the information to obtain position information describing how the fiber optic cable is positioned around the casing string; and building, by the processor, the model based on the position information.

16. A system comprising:

a plurality of sensor devices positionable in proximity to a fiber optic cable at a plurality of depths in a wellbore for transmitting a plurality of signals to the fiber optic cable, each sensor device of the plurality of sensor devices including:

a transmitter;

a sensor module including one or more sensors; and a sensor computing device communicatively coupled to the transmitter and the sensor module, the sensor computing device being configured to:

receive measured parameters indicating a position of the sensor module in the wellbore;

determine, based on the measured parameters, that the sensor device is located at a reference depth in the wellbore;

in response to determining that the sensor device is located at the reference depth in the wellbore, obtain a plurality of orientation angle measurements as the sensor device moves farther downhole from the reference depth;

subsequent to determining the plurality of orientation angle measurements, determine that the sensor device is stationary; and subsequent to determining that the sensor device is stationary, operate the transmitter to transmit at least one orientation angle measurement of the plurality of orientation angle measurements in at least one signal, wherein the at least one orientation angle measurement indicates an angular rotation of the sensor device between the reference depth and a final landing depth of the sensor device; and a perforating gun controller configured to automatically control a perforation operation at a target depth without damaging the fiber optic cable based at least in part on the at least one signal.

17. The system of claim 16, wherein each sensor device of the plurality of sensor devices is configured to:

determine a number of times in which the fiber optic cable is wrapped, in whole or in part, around the casing string between the reference depth and a final landing depth of the sensor device during deployment of the fiber optic cable in the wellbore; and incorporate the number of times into the at least one signal.

18. The system of claim 17, wherein the sensor device is configured to determine that the sensor device is stationary by detecting a reduced vibration level as compared to a prior vibration level, detecting a reduction of orientation angle variance, or detecting that a predefined amount of time has passed.

19. The system of claim 16, wherein each sensor device is configured to digitally encode an orientation angle measurement, a temperature, a pressure, a battery level, an inclination angle, or a fractional number of times that the fiber optic cable is wrapped around the casing string using one or more digital modulation techniques.

20. The system of claim 16, further comprising a processor and a memory positionable at a surface of the wellbore, the memory including instructions that are executable by the processor for causing the processor to:

receive data describing properties of the plurality of signals;

based on the properties of the plurality of signals, determine the target orientation for the perforating gun controller that avoids damaging the fiber optic cable during the perforation operation at the target depth in the wellbore; and output the target orientation to the perforating gun controller for enabling the perforation operation to be performed at the target depth without damaging the fiber optic cable.

* * * * *